US005188931A

United States Patent [19]

Marinelli et al.

[11] Patent Number: 5,188,931

[45] Date of Patent: Feb. 23, 1993

[54] PROCESS OF SIMULTANEOUSLY APPLYING MULTIPLE LAYERS OF HYDROPHILIC COLLOIDAL AQUEOUS COMPOSITIONS TO A HYDROPHOBIC SUPPORT AND MULTILAYER PHOTOGRAPHIC MATERIAL

[75] Inventors: Domenico Marinelli; Fulvio Furlan, both of Savona, Italy

[73] Assignee: Minnesota Mining and Manufacturing Company, St. Paul, Minn.

[21] Appl. No.: 471,872

[22] Filed: Jan. 29, 1990

[30] Foreign Application Priority Data

Feb. 9, 1989 [IT] Italy ..... 19373 A/89

[51] Int. Cl.[5] ..... B05D 1/30; G03C 1/76

[52] U.S. Cl. ..... 430/539; 430/935; 427/402; 427/420; 427/414

[58] Field of Search ..... 430/539, 935; 427/402, 427/414, 420

[56] References Cited

U.S. PATENT DOCUMENTS

| | | | |
|---|---|---|---|
| 2,761,791 | 9/1956 | Russell | 117/34 |
| 3,508,947 | 4/1970 | Hughes | 430/935 |
| 3,526,528 | 9/1970 | Takahashi et al. | 430/935 |
| 4,001,024 | 1/1977 | Dittman et al. | 96/87 |
| 4,051,278 | 9/1977 | Democh | 427/326 |
| 4,113,903 | 9/1978 | Choinski | 427/420 |
| 4,495,273 | 1/1985 | Pannocchia | 430/539 |
| 4,525,392 | 6/1985 | Ishizaki et al. | 427/420 |
| 4,569,863 | 2/1986 | Koepke et al. | 430/935 |
| 4,572,849 | 2/1986 | Koepke et al. | 430/935 |
| 4,840,881 | 5/1989 | Watanabe et al. | 435/935 |

FOREIGN PATENT DOCUMENTS 0048700 3/1982 European Pat. Off. .

OTHER PUBLICATIONS

H. Ammann-Brass and J. Pouradier 'Photographic Gelatin, Proc. of 5th IAG Conference held at Fribourg, Sep. 1988 part 1. pp. 66-81 "Active or Inert Gelatin-An Overview" by P. Koepff' 1989, Fribourt 1989 *p. 79*. Patent Abstracts of Japan vol. 4, No. 93 (C-017)5 Jul. 5, 1980 & JP-A-55 056 867 (Oriental Shashin Kogyo I.K.) Apr. 26, 1980 *Abstract*.

*Primary Examiner*—Jack P. Brammer

*Attorney, Agent, or Firm*—Gary L. Griswold; Walter N. Kirn; Mark A. Litman

[57] ABSTRACT

A process of simultaneously applying multiple layers of hydrophilic colloidal aqueous coating compositions to a moving support with a multilayer bead coating apparatus, which comprises applying as the first layer next to the support an hydrophilic colloidal aqueous composition comprising a high molecular weight, highly deionized gelatin in which there are dispersed fine droplets of a high temperature boiling water immiscible organic solvent, and a multilayer silver halide photographic material comprising a support on which there are spread at least one silver halide photosensitive layer and at least one auxiliary layer, and said material further comprising, spread over said support under said layers, a hydrophilic colloidal layer comprising high molecular weight, highly deionized gelatin in which there are dispersed fine droplets of a high temperature boiling water immiscible organic solvent.

11 Claims, 1 Drawing Sheet

PROCESS OF SIMULTANEOUSLY APPLYING MULTIPLE LAYERS OF HYDROPHILIC COLLOIDAL AQUEOUS COMPOSITIONS TO A HYDROPHOBIC SUPPORT AND MULTILAYER PHOTOGRAPHIC MATERIAL

FIELD OF THE INVENTION

This invention relates to silver halide photographic materials, and more precisely to multilayer photographic materials comprising a support having coated thereon at least one hydrophilic layer (i.e. permeable to the acqueous photographic treatment solutions) of an emulsion of silver halides dispersed in a hydrophilic colloid and at least one auxiliary hydrophilic colloid layer (for example, a filter layer, an external protective layer, an intermediate layer, an antihalation layer).

BACKGROUND OF THE ART

The art of multilayer coating has been highly developed, particularly in the manufacture of photographic materials which comprise a plurality of hydrophilic layers of different composition on a hydrophobic support.

These compositions are commonly diluted with a low temperature boiling solvent, such as water, for reducing their viscosity and improving coating speed, and they are coated with a multilayer slide bead coater, multilayer cascade coater, extrusion coater or the like onto a hydrophobic support. This coating operation is followed by a drying process in which the solvent is removed.

U.S. Pat. No. 2,761,791 describes a method of multilayer bead coating whereby a plurality of liquid coating compositions are simultaneously applied to a moving support while maintaining a distinct layer relationship. During said coating method, to avoid intermixing of the composition among the lowermost layer and the layer immediately above, it is ordinarily necessary to form the lowermost layer from a coating composition of low viscosity and of a substantial thickness so that vortical action, taking place within the coating bead, is retained entirely within the lowermost layer. However, this method with said low viscosity composition can be disadvantageous since a thick layer of low viscosity coating composition comprises a large amount of water which must be removed in drying process. It may then be necessary to operate at an undesirable low speed in order not to exceed the drying capacity of commercially practical drying equipment.

U.S. Pat. No. 4,001,024 describes an improved process of multilayer bead coating wherein the lowermost layer is coated over a support as a thin layer formed from a low viscosity coating composition and the layer immediately above is coated over said lowermost layer as a thicker layer of higher viscosity so that vortical action of the coating bead is confined to the lowermost layer and the layer immediately above it, while all other layers are coated in discrete form (not affected by the vortex). According to the aforesaid process, some intermixing results between the lowermost layer and the layer immediately above it so that is necessary to choose particular compositions to assure that this interlayer mixing is not harmful to the product.

A homogeneous coating quality is important for the production of high quality photographic materials, especially for the reproduction of image areas of uniform density. This can easily be achieved using multilayer bead coating techniques, if support materials of uniform thickness are available. The thickness of the multilayer liquid film, formed on the slide of the coating bar, remains uniform even after application onto the support. The photographic material is then set by chilling the whole system, whereby the uniform structure of the photographic layers is frozen in.

The surface of support material is uneven. However the multilayer liquid coatings applied on such a support tend to even out the irregular surface structure. If the aforesaid support has an uneven surface, it may provide an evident density variation pattern on the finished photographic material. In fact as soon as the low viscosity coating composition is laid down on the moving support, it copies any support pattern due to the residual running propensity of the coating composition before the chilling takes place and this pattern is copied by the upper layers.

The action of surface tension and gravity forces in the chilling zone therefore produces an irregular thickness profile of the photographic emulsion layers, which is frozen in after setting and can be seen as a mottled structure (particularly uneven coating formed in a direction orthogonal or parallel to the coating direction) in the final processed image. The resulting image likewise contains all the variations of the layer thickness induced by the structure surface of the support.

The time scale for this hydrodynamic process depends on the viscosity of the coating compositions, but for the range of 10–30 mPa/s (milliPascal per second), a half-life of 0.2 to 1 sec can be assumed. This process therefore is much faster than the concurrent viscosity increase of the coated liquid layers in the chilling bed, as described in the Research Disclosure 24844, December 1984.

Although various methods of improving coating quality have been described in the art, such as (1) the application of a set undercoat, on which the further liquid emulsion layers are applied at a second coating pass, or (2) the slowing down of the hydrodynamic processes through improved rheological properties of the coating solution, or (3) the control of the temperature in the coating zone, only marginal benefits can be gained in these ways. An example of method (1) is described in British Pat. No. 855.849. Examples of method (2) are described in U.S. Pat. No(s). 4,113,903 and 4,525,392. An example of method (3) is described in U.S. Pat. No. 4,051,278.

BRIEF DESCRIPTION OF THE DRAWING

The drawing is of a multilayer bead coating apparatus for curring out the present invention.

SUMMARY OF THE INVENTION

Figure 1:
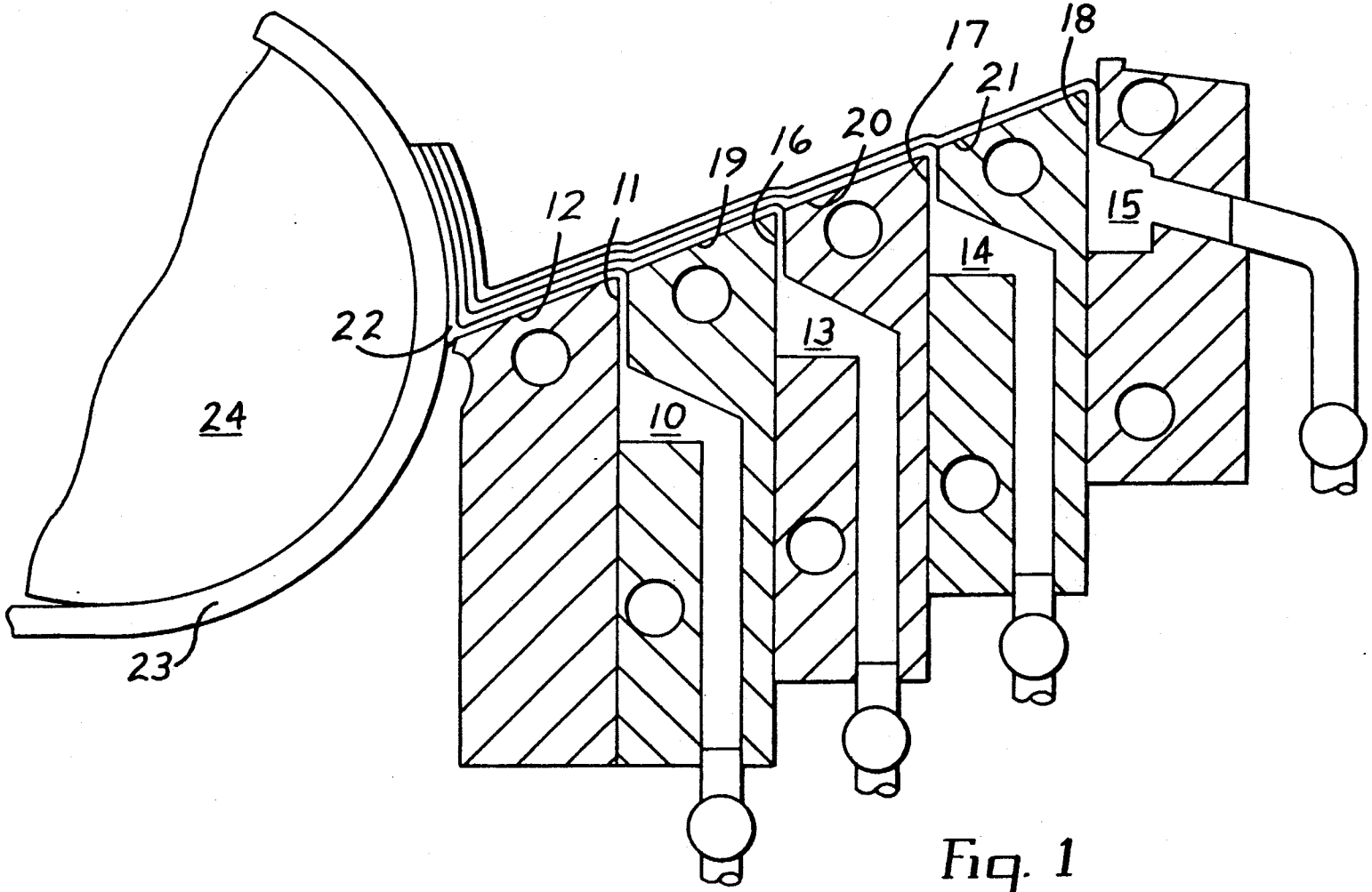

The present invention relates to a process of simultaneously applying multiple layers of hydrophilic colloid aqueous coating compositions to a moving support with a multilayer bead coating process, which comprises applying as the first layer next to the support an hydrophilic colloidal aqueous composition comprising high molecular weight, highly deionized gelatin in which there are dispersed fine droplets of a high temperature boiling water immiscible organic solvent.

According to the present invention, all the layers can be simultaneously coated while maintaining a distinct layer relationship (that is with no interlayer mixing) and avoiding an irregular thickness profile (that is with no density variation pattern on the finished photographic material).

DETAILED DESCRIPTION OF THE INVENTION

Accordingly, in one aspect the present invention relates to a process of simultaneously applying multiple layers of hydrophilic colloid aqueous coating compositions to a moving support with a multilayer bead coating process, which comprises applying as the first layer next to the support an hydrophilic colloidal aqueous composition comprising high molecular weight, highly deionized gelatin in which there are dispersed fine droplets of a high temperature boiling water immiscible organic solvent.

In another aspect the present invention relates to a multilayer silver halide photographic material comprising a support on which there are spread at least one silver halide photosensitive layer and at least one auxiliary layer, and said material further comprising, spread over said support under said layers, a hydrophilic colloidal layer comprising high molecular weight, highly deionized gelatin in which there are dispersed fine droplets of a high temperature boiling water immiscible organic solvent.

The multilayer bead coating apparatus suitable for use in carrying out the process of the present invention are known in the art, such as those described in U.S. Pat. No(s). 2,761,791 and 4,001,024. FIG. 1 shows a four slide bead coater by use of which four separate layers of the same or different composition may be simultaneously applied on a hydrophobic support 23 in accordance with the scope of present invention. In this device the first coating composition is continuously pumped at a given rate into a cavity 10 from which it is extruded through a narrow vertical slot 11 out onto a downwardly inclined slide surface 12 over which it flows by gravity to form a layer of that composition. Likewise other coating composition may be continuously pumped into chambers 13, 14, 15, and may be extruded from narrow vertical slots 16, 17, 18, respectively onto slide surfaces 19, 20, 21, respectively, down which they flow by gravity to form separate layers of different compositions. The four slide surfaces are coplanar so that as the layers of different coating compositions flow down their respective slide surfaces they are brought together in overlapping relation, and by the time the four layers reach the coating bead 22, they are combined in the desired laminated relationship. This distinct layer relationship is maintained throughout the bead so that as said hydrophobic support 23 is moved across and in contact with the bead by means of roll 24, it takes up on its surface the four layers of coating in the desired orientation. There is no limit as to the number of separate layers of coating compositions which may be laid down on said hydrophobic support with this type of apparatus as regard to its potentiality.

In the practice of the present invention, various types of photographic supports may be used to prepare the photographic materials. Suitable supports include polymeric films, such as cellulose nitrate films, cellulose acetate film, polystyrene film, polyvinyl acetal film, polycarbonate film, polyethylene terephthalate film and other polyester films, paper, glass, cloth, and the like. According to the present invention, photographic supports having uneven surface can be used. The term "uneven surface" in the present invention is used to indicate photographic supports having an irregular thickness profile, such as supports presenting down web oriented mottles with shifting values of about ±1% with respect to the average thickness value of the support.

According to the present invention, the first layer applied next to the support is formed of a hydrophilic colloid aqueous coating composition comprising a high molecular weight, highly deionized gelatin in which there are dispersed fine droplets of a high temperature boiling water immiscible organic solvent.

The high molecular weight, highly deionized gelatin which can be used for the purpose of the present invention is characterized by a higher percentage of high molecular weight fractions and a higher deionization with respect to the commonly used photographic gelatins. Preferably, the gelatin for use in the present invention has at least 35% of fractions with molecular weights higher than 250,000, as determined by Gel Permeation Chromatography, compared with commonly used photographic gelatins having less than 30% of fractions with molecular weights higher than 250,000. Still preferably, the gelatin for use in the present invention is almost completely deionized which is defined as meaning that it presents less than 50 ppm (parts per million) of $Ca^{++}$ ions and is practically absent (less than 5 parts per million) of other ions such as chlorides, phosphates, sulphates and nitrates, compared with commonly used photographic gelatins having up to 5,000 ppm of $Ca^{++}$ ions and the significant presence of other ions.

In the hydrophilic colloid aqueous coating composition used for forming the first layer coated next to the support according to the process of the present invention, said high molecular weight, highly deionized gelatin is present in a proportion of at least 30%, preferably at least 40% with respect to the total hydrophilic colloid content of said coating composition. The hydrophilic colloid of the coating composition is preferably the gelatin commonly used in photogarphic materials, but other hydrophilic colloids can be used such as protein derivatives, cellulose derivatives, polycaccharides such as starch, sugars such as dextran, synthetic polymers such as polyvinyl alcohol, polyacrylamide and polyvinylpyrrolidone, and other suitable hydrophilic colloids such as are disclosed in U.S. Pat. No. 3,297,446. More preferably said high molecular weight, highly deionized gelatin represents at least 90% or all the hydrophilic colloid of the coating composition.

The organic solvents which can be used for the purpose of the present invention are defined as non-polymeric organic compounds having a boiling point higher than 200° C. and a water solubility lower than 0.5 g. per liter at 25° C., and are ordinarily used in dispersing hydrophobic coupling agents and photographic additives as described, for example, in U.S. Patent Nos. 2,322,027, 2,501,170, 2,801,171, 2,801,171, 2,272,191, 2,304,940 and 3,748,141. Even though a wide variety of organic solvents can be used, those which are most preferable for the purpose of the present invention (because of the fact that they show no negative effects on the photosensitive material, are easily obtainable and easy to handle because of their excellence stability) have been found to be organic solvents chosen from the class consisting of dibutylphtalate, tricresylphosphate, triphenylphosphate, di-2-ethylhexylphthalate, di-n-octylphthalate, tris-2-ethylhexylphosphate, cetyltributylcitrate, di-n-hexyladipate, di-2-ethylhexiladipate, dimetylsebacate, triethyleneglycol-di-2-ethylhexoate, ethilphthalylethylglycolate, quinitol-bis(2-ethylhexoate) and 1,4 cyclohexyldimethylene-bis(2-hethylhexoate).

For the purpose of the present invention said organic solvents are dispersed in the form of fine droplets (of a size from 0.1 to 1 μm, more preferably, from 0.15 to 0.30 μm), which are produced by known methods, the most commonly used method consisting of first dissolving the organic solvent, either alone or in mixture (two or more), in a low temperature boiling solvent (such as methylacetate, ethylacetate, propylacetate, butylacetate, butylpropionate cyclohexanol, diethyleneglycolmonoacetate, nitromethane, carbon tetrachloride, chloroform, cyclohexane, tetrahydrofuran, methylalcohol, ethylalcohol, propylalcohol, acetonitrile, dimethylformamide, dioxane, acetone, methylethylketone, methylisobutylketone, and the like, used either individually or in combination), then mixing the solution with an acqueous solution of a hydrophilic colloid containing one or more anionic dispersing agents of the type normally used in photography (such as dioctylsodiumsulfosuccinate, sodiumlaurylsulfate, sodiumalkylnaphtalenesulfate and others described in Schwarty et al., Surface Active Agents and Detergents, Vol. 1 and 2, Intersciences Publishers, and in U.S. Pat. Nos. 2,992,108, 3,068,101, 3,201,252 and 3,165,409, in French Patent Nos. 1,556,240 and 1,497,930 and U.K. Patent Nos. 580,504 and 985,483), in particular cases where necessary, cationic or non-ionic dispersing agents (of the type described, for example, in U.K. Patent No. 1,274,523 and in U.S. Pat. Nos. 3,762,025 and 3,860,425), and finally dispersing the composition obtained in this manner using a suitable means such as a colloidal mill, a high speed rotating mixer or an ultrasonic disperser. Additionally the organic solvent droplets could include photographic additives of a hydrophilic nature, and more preferably of an hydrophobic nature such as UV absorbers, anti-staining agents, compound which release developing inhibitors, optical bleaches, anti-oxidants, dyes, color couplers and the like.

In the hydrophilic colloid coating composition used for forming the first layer coated next to the support according to the process of the present invention, said organic solvent is present in proportion of from 50 to 200%, preferably 140 to 180% with respect to the high molecular weight, highly deionized gelatin of the coating composition.

According to the present invention, it has been found that said hydrophilic colloid aqueous coating composition, comprising the high molecular weight, highly deionized gelatin in which there are dispersed fine droplets of a high temperature boiling water immiscible organic solvent, presents a high viscosity, for example from 50 to 200 mPa/s, at low shear rate, such as at shear conditions available in the slide and bead regions of a bead coater according to FIG. 1, and a low viscosity, for example from 5 to 40 mPa/s, at high shear rate, such as at shear conditions available when the liquid layer is drawn down onto the support. The high viscosity at low shear rates increases the bead stability and the low viscosity at high shear rates increases the coating speed and the wettability of the support. Again, the coating composition, used to form the first layer spread next to the support, presents a high viscosity when the liquid has come to rest relative to the support (where no shear exists) after it has been coated and before it has set and/or been dried on the support, thus providing a uniform surface, despite of the possible thickness variations of the support, for the other layers simultaneously coated with it. Under these conditions a coating free from mottles can be achieved.

According the other aspect, the present invention relates to a photographic multilayer material comprising a support on which there are spread at least one silver halide photosensitive layer and at least one auxiliary layer, wherein the layer first spread next to the support under said layers is a hydrophilic colloid layer comprising a high molecular weight, highly deionized gelatin in which there are dispersed fine droplets of a high temperature boiling water immiscible organic solvent.

The present invention relates in particular to color photographic materials comprising a hydrophobic support on which there are spread a plurality of hydrophilic layers of silver halides dispersed in gelatin and auxiliary hydrophilic gelatin layers (such as, e.g., filter layers, external protective layers, intermediate layers, antihalation layers), wherein the layer first spread next to the support under said plurality of layers is a hydrophilic colloid layer comprising a high molecular weight, highly deionized gelatin in which there are dispersed fine droplets of a high temperature boiling water immiscible organic solvent.

The silver halide emulsions are naturally sensitive (or sensitized) towards blue, and are associated with non-diffusing coupling agents forming yellow dyes (with aromatic diamine color development after exposure), or are sensitized towards green and associated with non-diffusing coupling agents forming magenta (blue-red) dyes, or are sensitized towards red and associated with non-diffusing coupling agents forming cyan (blue-green) dyes.

The present invention relates more in particular to the aforesaid photographic material, in which said layer first spread next to the support is an antihalation layer, preferably an antihalation layer incorporating colloidal or globular silver. Preferably, the present invention relates to the aforesaid photographic material, in which said layer has a thickness of between about 1 and 10 μm, and more preferably between about 2 and about 6 μm.

Although the invention is particularly suitable for conventional color photographic materials of negative or reversal type designed for in camera exposure, it can be also useful for other color photographic materials characterized by a different arrangement of sensitive layers, such as positive materials for the cinema, printing, duplicating, etc. as well as for black and white photographic materials.

The material can also contain chemical sensitizers, spectral sensitizers and desensitizers, optical bleaches, antifog and stabilizing agents, coupling agents, screening and antifog dyes, hydrophilic colloid and gelatin substituents, hardeners, spreading agents, plasticizers, antistatic agents and matting agents as known to the expert of the art, and treated in various treatments as described in Research Disclosure, December 1978, 17643, which is incorporated herein by reference.

The present invention will be better described and illustrated by the following examples of its practice.

EXAMPLE 1

A first aqueous composition 1 was prepared comprising per liter of composition:

| | |
|---|---|
| gelatin A (total) | 50 g |

-continued

| | |
|---|---|
| dispersed black colloidal silver | 358 g |
| dispersion 1 | 483 g |

Gelatin A was a commonly used photographic gelatin having a viscosity in water (at 40° C. and 6.2% concentration by weight) of 7.48 mPA/s, a concentration of $Ca^{++}$ ions of 4,940 ppm and less than 27% of fractions having molecular weights higher than 250,000.

Preparation of dispersion 1:

Twelve g of dibuthylphthalate were mixed with 13.50 g of ethylacetate at 45° C. The obtained solution was added under stirring to 45 g of an aqueous solution of gelatin A at 10% containing 9.0 g of the anionic surfactant Nekal BX manufactured by BASF AG, the mixture then being dispersed by means of a rotatory homogenizer to give 1000 g of dispersion 1.

A second aqueous composition 2 was prepared comprising per liter of composition:

| | |
|---|---|
| gelatin B (total) | 50 g |
| dispersed black colloidal silver | 358 g |
| dispersion 2 | 483 g |

Gelatin B was a high molecular weight highly deionized gelatin having a viscosity in water (at 40° C. and 6.2% by weight) of 10.51 mPA/s, a concentration of $Ca^{++}$ ions of 40 ppm and more than 40.2% of fractions having molecular weights higher than 250,000.

Preparation of dispersion 2:

Dispersion 2 was prepared in a manner like to dispersion 1 but using gelatin B instead of gelatin A.

The viscosity values versus the shear rate of the two compositions were measured at 40° C. using a computerized Brabender Rheotron Rheometer manufactured by Brabender OHG.

The following table 1 reports the values of viscosity at various shear rates.

TABLE 1

| | Viscosity (mPA/s) at | | |
|---|---|---|---|
| Composition | $<1\ sec^{-1}$ (no shear) | $10\ sec^{-1}$ (low shear) | $10^4\ sec^{-1}$ (high shear) |
| 1 | 14 | 14 | 13 |
| 2 | 230 | 75 | 20 |

EXAMPLE 2

A multilayer photographic film 1 was prepared spreading (using the bead coater of FIG. 1) the following layers over an uneven cellulose triacetate support in two coating passes in the indicated order.

First coating pass:

First layer: An antihalation layer of 1,25 g/m² of gelatin containing 0.16 g/m² of black colloidal silver, 2.5 g/m² of the dispersion 1 of example 1.

Second coating pass:

Second layer: A layer of silver bromo-iodide emulsion low sensitivity towards red (formed from a gelatin emulsion of silver bromo-iodide grains) containing 1.18 g/m² of silver and 1.5 g/m² of gelatin and a cyanophenolic coupling agent A and a colored cyanonaphtholic coupling agent B dispersed in a mixture of tricresylphosphate and dibutylphthalate.

Coupler A:

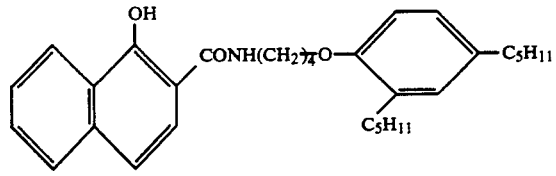

Coupler B:

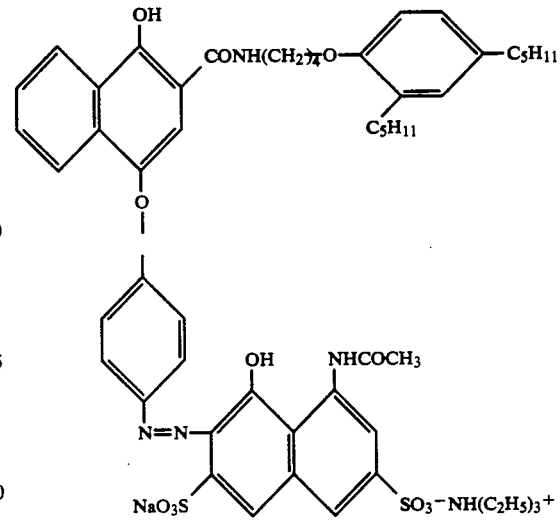

Third layer: A layer of silver bromo-iodide emulsion of high sensitivity towards red (formed from a gelatin emulsion of silver bromo-iodide grains) containing 0.94 g/m² of silver and 1.4 g/m² of gelatin and a cyanophenolic coupling agent C and the same colored cyanonaphtholic coupling agent B as the second layer dispersed in tricresylphosphate.

Coupler C:

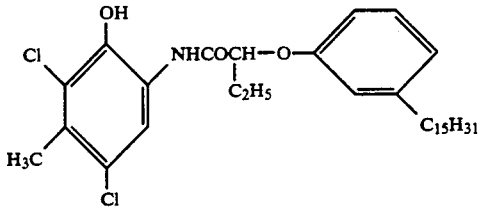

Fourth layer: A layer of 1.0 g/m² of gelatin containing 2,5 diisooctylhydroquinone dispersed in triphenilphosphate and dibutyl phthalate.

The gelatin used to form all the layers of Film 1 was gelatin A of example 1.

A multilayer photographic film 2 was prepared by spreading the following layers over an uneven cellulose triacetate support in a single coating pass in the indicated order.

First layer: An antihalation layer of 1,5 g/m² of gelatin containing 0.16 g/m² of black colloidal silver, 2.5 g/m² of dispersion 1.

Second layer: A layer of silver bromo-iodide emulsion of low sensitivity towards red (formed from a gelatin emulsion of silver bromo-iodide) containing 1.18 g/m² of silver and 1.5 g/m² of gelatin and the cyanophenolic coupling agent A and the colored cyanonaphtholic coupling agent B dispersed in a mixture of tricresylphosphate and dibutylphthalate.

Third layer: A layer of silver bromo-iodide emulsion of high sensitivity towards red (formed from a gelatin emulsion of silver bromo-iodide) containing 0.94 g/m$^2$ of silver and 1.4 g/m$^2$ of gelatin and the cyanophenolic coupling agent C and the same colored cyanonaphtholic coupling agent B as the second layer dispersed in tricresylphosphate.

Fourth layer: A layer of 1.0 g/m$^2$ of gelatin containing 2,5 diisooctylhydroquinone dispersed in triphenilphosphate and dibutyl phthalate.

The gelatin used to form all the layers of film 2 was gelatin A of example 1.

A multilayer photographic film 3 was prepared by spreading simultaneously the following layers over an uneven cellulose triacetate support in a single coating pass in the indicated order.

First layer: An antihalation layer of 1,25 g/m$^2$ of the high molecular weight high deionized gelatin B of example 1 containing 0.16 g/m$^2$ of black colloidal silver and 2.5 g/m$^2$ of dispersion 2 of example 1.

Second layer: A layer of silver bromo-iodide emulsion of low sensitivity towards red (formed from a gelatin emulsion of silver bromo-iodide, said gelatin formed from a mixing of 20% of the high molecular weight highly deionized gelatin B and 80% of the gelatin A of example 1) containing 1.18 g/m$^2$ of silver and 1.5 g/m$^2$ of said gelatin and the cyanophenolic coupling agent A and the colored cyanonaphtholic coupling agent B dispersed in a mixture of tricresylphosphate and dibutylphthalate.

Third layer: A layer of silver bromo-iodide emulsion of high sensitivity towards red (formed from a gelatin emulsion of silver bromo-iodide, said gelatin formed from a mixing of 20% of the high molecular weight highly deionized gelatin B and 80% of the gelatin A of example 1) containing 0.94 g/m$^2$ of silver and 1.4 g/m$^2$ of said gelatin and the cyanophenolic coupling agent C and the same colored cyanonaphtholic coupling agent B as the second layer dispersed in tricresylphosphate.

Fourth layer: A layer of 1.0 g/m$^2$ of gelatin A of example 1 containing 2,5 diisooctylhydroquinone dispersed in triphenylphosphate and dibutyl phthalate.

A multilayer photographic film 4 was prepared by spreading simultaneously the following layers over an uneven cellulose triacetate support in a single coated pass in the indicated order.

First layer: An antihalation layer of 1.5 g/m$^2$ of a mixing of 40% of the high molecular weight highly deionized gelatin B and 60% of the gelatin A of example 1 containing 0.16 g/m$^2$ of black colloidal silver and 2.5 g/m$^2$ of dispersion 2.

Second layer: A layer of silver bromo-iodide emulsion of low sensitivity towards red (formed from a gelatin emulsion of silver bromo-iodide, said gelatin formed from a mixing of 20% of the high molecular weight highly deionized gelatin B and 80% of the gelatin A of example 1) containing 1.18 g/m$^2$ of silver and 1.5 g/m$^2$ of said gelatin and the cyanophenolic coupling agent A and the colored cyanonaphtholic coupling agent B dispersed in a mixture of tricresylphosphate and dibutylphthalate. Third layer: A layer of silver bromo-iodide emulsion of high sensitivity towards red (formed from a gelatin emulsion of silver bromo-iodide, said gelatin formed from a mixing of 20% of the high molecular weight highly deionized gelatin B and 80% of the gelatin A of example 1) containing 0.94 g/m$^2$ of silver and 1.4 g/m$^2$ of said gelatin and the cyanophenolic coupling agent C and the same colored cyanonaphtholic coupling agent B as the second layer dispersed in tricresylphosphate.

Fourth layer: A layer of 1.0 g/m$^2$ of gelatin containing 2,5 diisooctylhydroquinone dispersed in triphenylphosphate and dibutyl phthalate.

All the multilayer photographic films of the example, coated over the uneven support, were obtained by coating the corresponding aqueous coating compositions using a bead coater of the type in FIG. 1 at 70 m/min coating speed and drying.

The relative samples were incubated (38° C., 50% relative humidity) overnight in the oven to reach the desired hardness and then processed following standard procedures.

The coating quality of the photographic films related to down web oriented mottles was subjectively evaluated by scores:

| | |
|---|---|
| 2, 3, 4, = | nonuniformity patterns visible in printing in all conditions |
| 5 = | nonuniformity patterns visible in printing in particular conditions |
| 6 = | nonuniformity patterns present but not visible in printing |
| 7 = | nonuniformity patterns practically absent |
| 8 = | nonuniformity patterns absent |

A similar method has been applied for the evaluation of the overall coating quality:

| | |
|---|---|
| 4 = | to be rejected |
| 6 = | still acceptable, but with scrapes |
| 8 = | in conformity to customer requirements. |

The results of the four sample films are shown in Table 2, from which it is clear that the same results obtained with film 1 (reference four layer film obtained with a double coating pass) are obtained with films 3 and 4 (four layer films obtained, according this invention, with a single coating pass).

TABLE 2

| Number | Overall coating quality rating | Down web oriented mottles score |
|---|---|---|
| 1 | 8 | 8 |
| 2 | 6 | 4 |
| 3 | 8 | 8 |
| 4 | 8 | 8 |

The invention has been described in detail with particular reference to preferred embodiments thereof, but it will be understood that variations and modifications (as, for examples, for the preparation of other photographic multilayer materials) can be effected within the spirit and scope of the invention.

We claim:

1. A process comprising simultaneously applying multiple layers of hydrophilic colloidal aqueous coating compositions to a moving support with a multilayer bead coating apparatus, wherein the first layer applied next to the support is an hydrophilic colloidal aqueous composition comprising a high molecular weight, highly deionized gelatin having at least 35% by weight of gelatin fractions with molecular weights higher than 250,000 in which there are dispersed fine droplets of a high temperature boiling water immiscible organic solvent.

2. The process of claim 1, wherein said high molecular weight high deionized gelatin has at least 35% of fractions with molecular weight higher than 250,000 and a $Ca^{++}$ content lower than 50 ppm.

3. The process of claim 1, wherein said high temperature boiling water immiscible organic solvent has a boiling point higher than 200° C. and a water solubility lower than 0.5 g. per liter at 25° C.

4. The process of claim 1, wherein said high temperature boiling water immiscible organic solvent is chosen from the class consisting of dibutylphtalate, tricresylphosphate, triphenylphosphate, di-2-ethylhexylphthalate, di-n-octylphthalate, tris-2-ethylhexylphosphate, cetyltributylcitrate, di-nhexyladipate, di-2-ethylhexiladipate, dimetylsebacate, triethyleneglycol-di-2-ethylhexoate, ethylphthalylethylglcolate, quinitol-bis-(2-ethylhexoate) and 1,4 cyclohexyldimethylene-bis-(2-ethylhexoate).

5. The process of claim 1, wherein said dispersed droplets have an average size of between 0.1 and 1 μm.

6. The process of claim 1, wherein said high molecular weight, highly deionized gelatin is in proportion of at least 30% with respect to the hydrophilic colloid of the coating composition.

7. The process of claim 1, wherein said organic solvent is in proportion of from 50 to 200% with respect to the high molecular weight, highly deionized gelatin of the coating composition.

8. The process of claim 1 wherein a multi-layer bead is laid down by said apparatus, and at least one layer of said bead other than said deionized gelatin first layer comprises a photographic silver halide emulsion.

9. The process of claim 2 wherein a multi-layer bead is laid down by said apparatus, and at least one layer of said bead other than said deionized gelatin first layer comprises a photographic silver halide emulsion.

10. The process of claim 3 wherein a multi-layer bead is laid down by said apparatus, and at least one layer of said bead other than said deionized gelatin first layer comprises a photographic silver halide emulsion.

11. The process of claim 4 wherein a multi-layer bead is laid down by said apparatus, and at least one layer of said bead other than said deionized gelatin first layer comprises a photographic silver halide emulsion.

* * * * *

UNITED STATES PATENT AND TRADEMARK OFFICE

CERTIFICATE OF CORRECTION

PATENT NO. : 5,188,931

DATED : February 23, 1993

INVENTOR(S) : Marinelli et al.

It is certified that error appears in the above-indentified patent and that said Letters Patent is hereby corrected as shown below:

Column 7, lines 53-54, after the word "prepared" and before the word "spreading", insert --by--.

Signed and Sealed this

Fourth Day of October, 1994

Bruce Lehman

*Attest:*

BRUCE LEHMAN

*Attesting Officer*

*Commissioner of Patents and Trademarks*